United States Patent [19]

Grobman

[11] 4,003,300

[45] Jan. 18, 1977

[54] APPARATUS HAVING DUAL SLOTTER SHAFTS

[75] Inventor: William Grobman, Philadelphia, Pa.

[73] Assignee: Molins Machine Company, Inc., Camden, N.J.

[22] Filed: Apr. 9, 1976

[21] Appl. No.: 675,369

Related U.S. Application Data

[63] Continuation-in-part of Ser. No. 504,934, Sept. 11, 1974, Pat. No. 3,954,050.

[52] U.S. Cl. ..... 93/58.2 R; 83/504; 83/699; 93/58 R

[51] Int. Cl.[2] ..... B31B 1/22

[58] Field of Search ..... 93/58 R, 58.2 R, 58.2 F; 83/58.1, 58.4, 58.5, 332, 425.4, 498, 499, 500, 504, 663, 671, 678, 699

[56] References Cited

UNITED STATES PATENTS

| | | | |
|---|---|---|---|
| 3,003,403 | 10/1961 | Goettsch | 93/58.2 R |
| 3,080,783 | 3/1963 | Knepshield | 83/499 X |
| 3,353,460 | 11/1967 | Henc | 93/58.2 R |
| 3,760,697 | 9/1973 | Besemann | 93/58.2 R |
| 3,837,265 | 9/1974 | Tokuno | 83/425.4 X |
| 3,952,637 | 4/1976 | Lambert et al. | 93/58.2 R |

*Primary Examiner*—Roy Lake
*Assistant Examiner*—E. F. Desmond
*Attorney, Agent, or Firm*—Seidel, Gonda & Goldhammer

[57] ABSTRACT

Apparatus such as a paperboard printer slotter is provided with dual slotter shafts each having a device to quickly reposition a slotter knife by moving the same in a circumferential direction with respect to an annular head which supports the same. During such positioning of the slotter knife, it is held stationary while the annular support head is rotated. This slotter knife is releasably mounted on its head and a means is provided to selectively release the lock when it is desired to reposition the knife. The knives on one slotter shaft cut a slot on the leading edge of a first blank and the trailing edge of a following blank. The knives on the other slotter shaft cut the slot on the trailing edge of the first blank and the leading edge of the following blank.

7 Claims, 6 Drawing Figures

FIG. 1
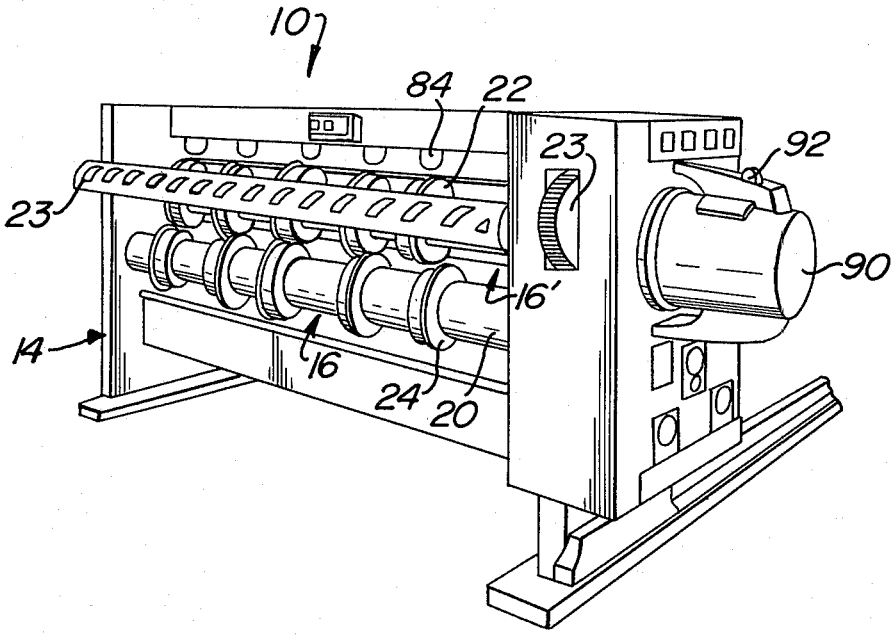
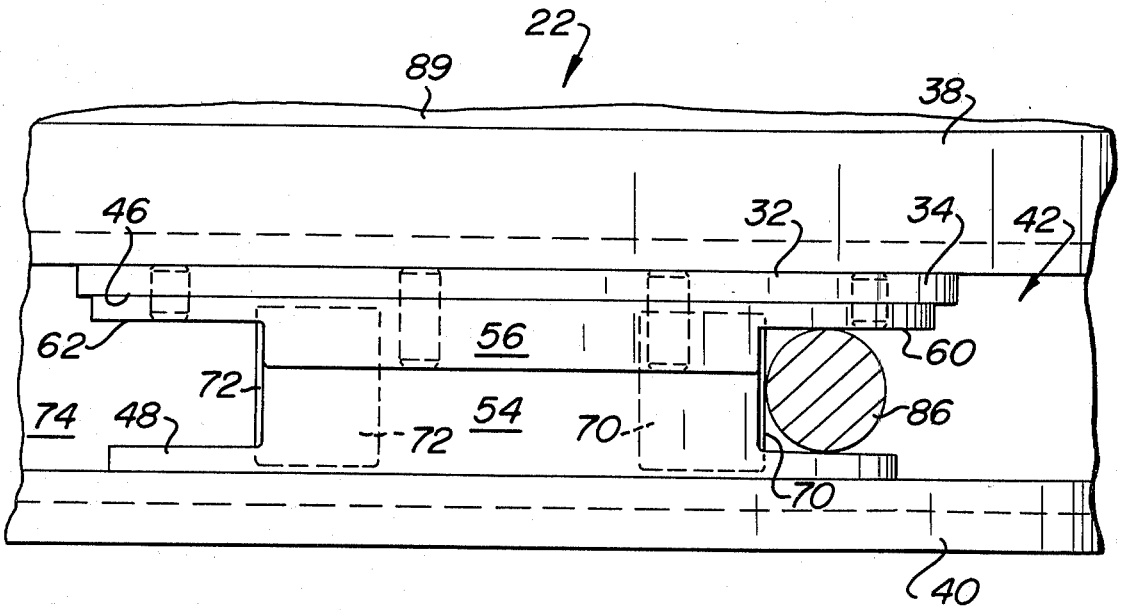
FIG. 4

APPARATUS HAVING DUAL SLOTTER SHAFTS

PRIOR CO-PENDING APPLICATION

This application is a continuation-in-part of my co-pending application Ser. No. 504,934 filed Sept. 11, 1974 U.S. Pat. No. 3,954,050 and entitled "Apparatus Having a Quick-Set Slotter Knife."

BACKGROUND OF THE INVENTION

A paperboard printer slotter is exemplary of a machine which has a plurality of slotting heads mounted on a common shaft. Prior to a production run, it is frequently necessary to readjust the positions of the slotting heads and knives due to a change in the size of the paperboard blank to be processed.

The paperboard blank is generally provided with three pairs of slots as it passes through the slotting portion of the printer slotter. Three slots are cut into the leading edge of the paperboard blank and three slots are cut into the trailing edge of the paperboard blank. Each slot on the leading edge is aligned with a slot on the trailing edge. All of said slots are cut by the knives on a single shaft with one blank being processed per revolution of said shaft.

Conventional slotting heads on a printer slotter are provided with at least two slotter knives which project beyond the periphery of the head and each knife is adapted to cooperate with an annular groove in an opposing female slotting head. The slotting heads are mounted on rotatable parallel shafts. The slotter knives have been customarily attached to their respective heads by clamping bolts. The clamping bolts are adapted to be loosened manually so that the knives may be circumferentially adjusted on their heads in order that they may be used to slot different sizes of box blanks.

U.S. Pat. Nos. 2,117,220 and 3,003,403 are exemplary of the prior art. In order to adjust a slotter knife, it is necessary to move sections of the printer-slotter away from each other to facilitate access to the slotting heads. Thereafter, bolts are loosened and one knife is adjusted circumferentially with respect to the other head. After each knife has been adjusted, the sections of the printer slotter are then moved to a closed operative disposition. In the course of a day's operation, 10–20% of the time may be used in adjusting the elements of the printer slotter to process different sizes of paperboard box blanks.

An attempt was made in a prior art slotter to set the knives on all heads simultaneously. In this design, one knife is fixed to the slotter head in the normal fashion, with the second knife bolted to a ring gear in the head. A shaft through all heads engaging the ring gear has a single control mechanism on the center head so all knives can be positioned at one time.

Disclosure of the Invention

The present invention is directed to apparatus having a pair of slotting shafts each having a slotting head whereby the slotter knives may be rapidly adjusted to a desired position for a new production run. The apparatus includes a number of annular slotting head assemblies mounted on parallel shafts for rotation about a transverse horizontal axis. Each annular head is secured to its shaft for rotation therewith. A motor means is connected to each shaft for rotating the shaft through a preselected angle to make the adjustment.

At least one slotter knife is releasably mounted on each annular head. A means is provided for automatically locking the releasably mounted slotter knife to its head and a means is provided for selectively releasing the locking means. When the locking means is released, the slotter knife is held stationary by the releasing means while its shaft with the heads is rotated by said motor means through a preselected angle whereby the movable slotter knife is repositioned on the periphery of said head.

The knives on one slotter shaft cut slots on the leading edge of one blank and the trailing edge of a following blank. The knives on the other slotter shaft cut slots on the trailing edge of said one blank and the leading edge of the immediately following blank. In this manner, two sheets are processed during each cycle of the machine, thereby doubling the output of the slotting machine.

It is to be appreciated that for each pair of blanks processed per machine cycle, the distance from the leading edge of said one blank to the trailing edge of the following blank must not exceed the periphery of the annular head.

For the purpose of illustrating the invention, there is shown in the drawings a form which is presently preferred; it being understood, however, that this invention is not limited to the precise arrangements and instrumentalities shown.

FIG. 1 is a perspective view of a printer-slotter slotting unit.

FIG. 4 is an elevation view taken along the line 4—4 in FIG. 2.

Figure 2:
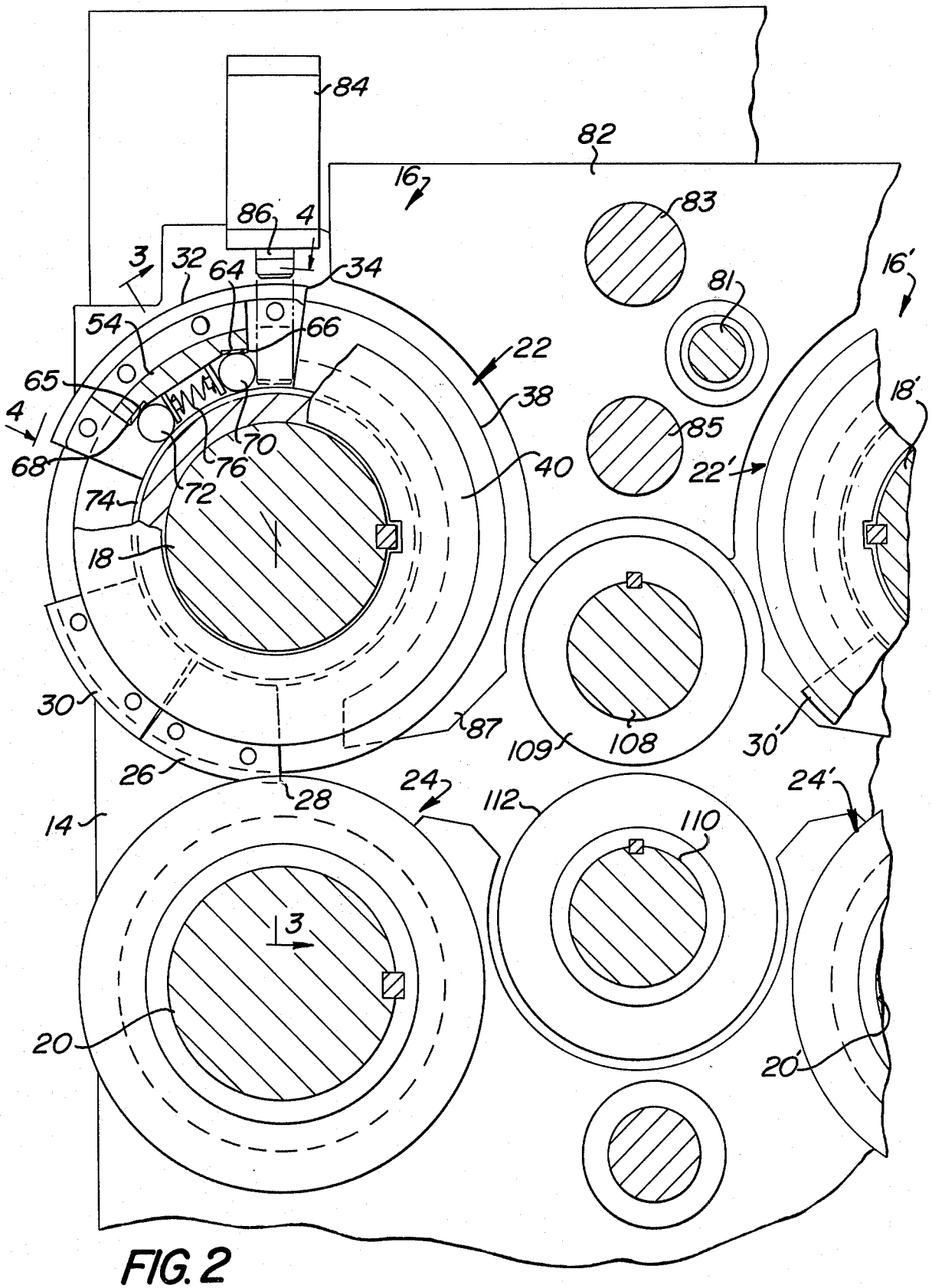
FIG. 2 is a vertical sectional view of a slotting assembly in accordance with the present invention.

Referring to the drawing in detail, wherein like numerals indicate like elements, there is shown in FIG. 1 a perspective view of apparatus 10 such as a slotting unit of a paperboard printer slotter.

The apparatus 10 includes side frames 12 and 14 mounted on separate bases. Slotting assemblies 16 and 16' extends transversely across the apparatus 10 and are rotatably supported at its ends by the side frames 12 and 14. Assemblies 16 and 16' are identical. Hence, only assembly 16 will be described in detail with corresponding primed numerals being used for corresponding structure on assembly 16'. The assembly 16 includes an upper shaft 18 and a lower shaft 20 disposed one above the other. See FIG. 2. Shaft 18 supports a plurality of male slotting heads 22. Shaft 20 supports a plurality of female slotter heads 24. Shaft 18 is geared to shaft 20 and is connected to a drive gear 23.

The slotting heads 22 and 24 are driven by the respective shafts 18, 20. Also, each slotting head is coupled to its shaft by means of a key or other equivalent device so that the slotting heads may be repositioned along the length of their respective shafts.

Each of the slotting heads 22 is identical, and cooperates with a female head 24. Hence, only one slotting head 22 will be described in detail. Referring to FIG. 2, it will be noted that the slotting head 22 has a fixed knife 26 provided with a cutting tip 28. Adjacent thereto and in line therewith, the slotting head 22 may be provided with an auxiliary knife 30 which is utilized to extend the length of a desired cut. Use of knife 30 is optional.

Figure 3:
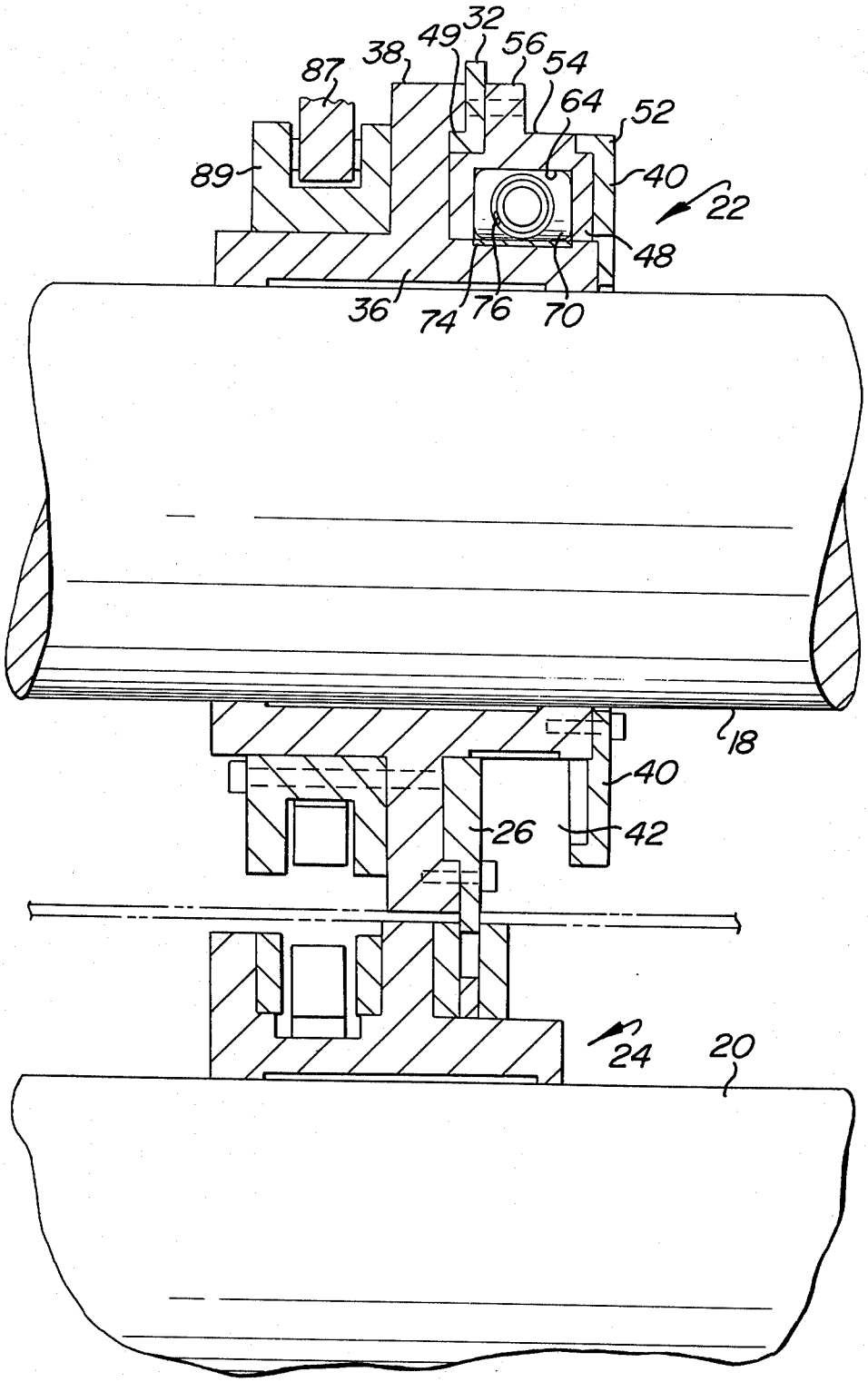
FIG. 3 is a sectional view taken along the line 3—3 in FIG. 2.
Figure 5:
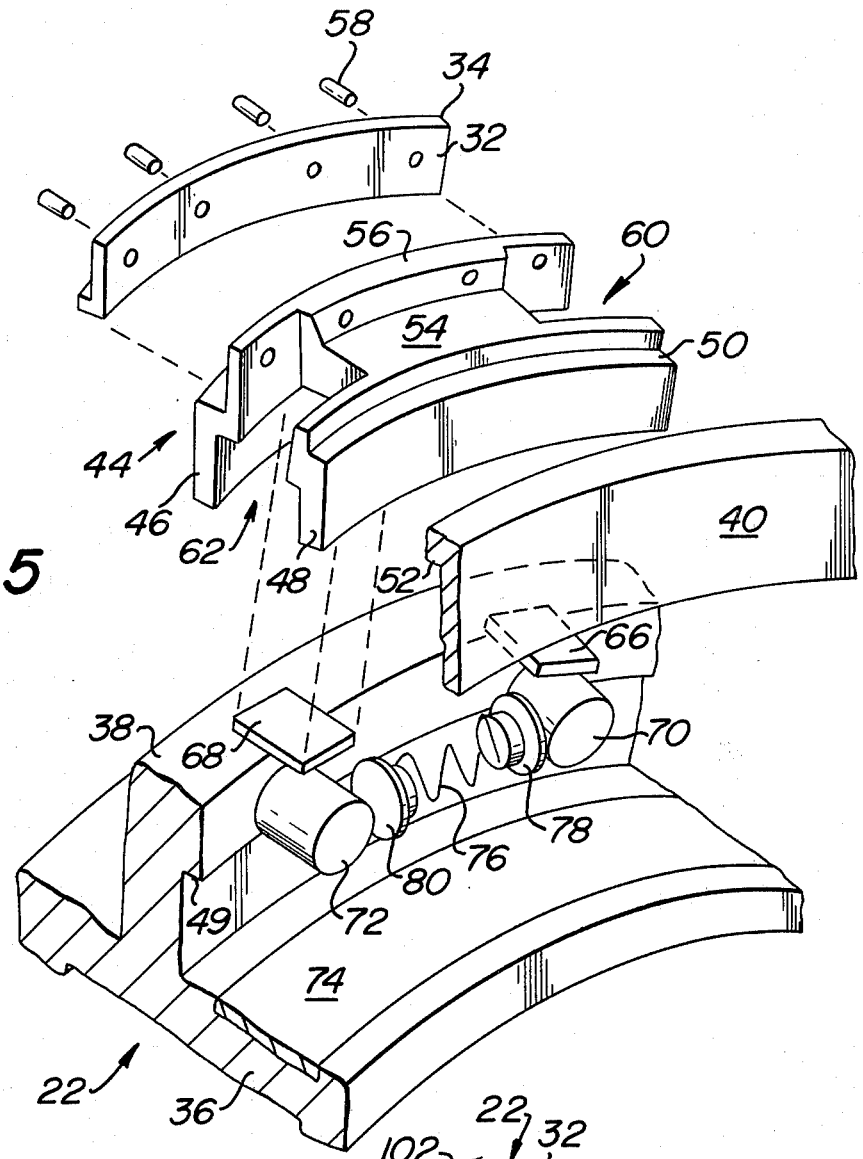
FIG. 5 is an exploded perspective view of a slotting assembly in accordance with the present invention.

Referring to FIGS. 3 and 5, the slotting head 22 includes a collar 36 which surrounds the shaft 18. Collar 36 has a centrally disposed, radially outward extending flange 38. A retainer 40 is removably bolted to a side face of the collar 36 so as to define with the flange 38 a channel 42 coaxial with shaft 18. Channel 42 is substantially open about the outer periphery of the head 22 as shown more clearly in the lower portion of FIG. 3.

A knife carrier 44 is disposed within and selectively positionable along the channel 42. See FIGS. 3 and 5. The knife carrier 44 has radially, inward extending legs 46 and 48 interconnected by a body portion 54. Leg 48 has a shoulder 50 over which lies a rim 52 on the retainer 40. Flange 38 has a lip 49 which overlies an adjustable knife 32. The lip 49 and rim 52 prevent the carrier 44 from moving radially outward from its desired position on the head 22.

The knife carrier 44 has a radially, outward extending rib 56. The knife 32 overlies the leg 46 and is removably connected to rib 56 by fasteners 58 which may be screws or bolts.

The knife carrier 44 is provided with a notch 60 at one end and a similar notch 62 at the opposite end. See FIGS. 4 and 5. Due to the provision of the notches 60, 62, the body portion 54 is shorter in length than the rib 56 and the legs 46, 48. Due to the presence of the notches 60, 62, the thickness of the rib 56 is greater in its central portion than it is adjacent its ends. See FIG. 5.

Referring to FIG. 2, it will be noted that the interior of the body portion 54 includes a flat surface 64 which is approximately perpendicular to the inner face of notch 60. A similar flat surface 65 is approximately perpendicular to the inner face of notch 62. A wear plate 66 covers surface 64 and a wear plate 68 covers surface 65. A hardened steel roller 70 is juxtaposed to the wear plate 66 and a similar roller 72 is juxtaposed to the plate 68. See FIGS. 2 and 5.

A peripheral surface of collar 36 includes a wear plate 74. Each of the rollers 70, 72 is in rolling contact with the wear plate 74. The radial distance between the right hand end portion of wear plate 66 and wear plate 74 is less than the diameter of roller 70. Similarly, the distance between the left hand end portion of wear plate 68 and the wear plate 74 is less than the diameter of the roller 72. In this manner, the rollers 70 and 72 are captured between the wear plate 74 on collar 36 and the wear plates 66, 68 on the knife carrier 44.

A spring 76 biases the rollers 70 and 72 away from each other. Spring 76 has a contact member 78 at one end for contact with the roller 70. A similar contact member 80 is provided on the other end of spring 76 for contact with roller 72.

Referring to FIG. 2, there is provided a yoke 82 for each slotting head 22. The yoke 82 is guided for horizontal translation by means of guide shafts 83 and 85. A threaded drive shaft 81 is threadedly coupled to the yoke 82 for causing the same to reciprocate to a desired position along the length of the guide shafts 83 and 85. Yoke 82 has a portion 82 which extends into a ring 89 on the collar 36. See FIG. 3. Hence, as the yoke 82 is moved, it moves its associated slotting head 22 along shaft 18.

The yoke 82 is provided with a motor means which may be in the form of a solenoid. Preferably, the motor means is a pneumatic cylinder 84 having a plunger 86. In the operative position of plunger 86, it is spaced from the peripheral surface of the head 22 but aligned with the channel 42. When motive fluid is introduced into cylinder 84, plunger 86 moves radially inward to the phantom position shown in FIG. 2. As shown in FIG. 4, the notch 60 is sufficiently large to accommodate the plunger 86 and permit the plunger 86 to have contact with the roller 70.

A compensator 90 is connected to each of shafts 18 and 18'. The compensator 90 is operated by means of a switch 92 which causes a motor 93 to rotate shaft 18 or shaft 18'. Such rotation of shaft 18 or 18' is completely independent of the conventional drive means for rotatably driving shafts 18, 18' and 20, 20'. When the compensator 90 is actuated, it permits circumferential adjustment of the shaft 18 or 18' so as to correctly register the location of slots 98, 100, 104, 106 in the paperboard box blanks 96, 102. Registration is obtained by rotating shaft 18 or 18' about its longitudinal axis so that the register arrow 94 points to the proper slot depth on the register dial 95. Registration by way of compensator 90 as described above is conventional. As will be explained hereinafter, the compensator 90 will perform an additional function when it is desired to change the position of the adjustable knife 32.

Scoring shaft 108 is provided with a scoring head 109 and is located between vertical planes containing the axes of shafts 18, 18'. See FIG. 2. Scoring shaft 110 is provided with a scoring head 112 and is located directly below shaft 108.

Figure 6:
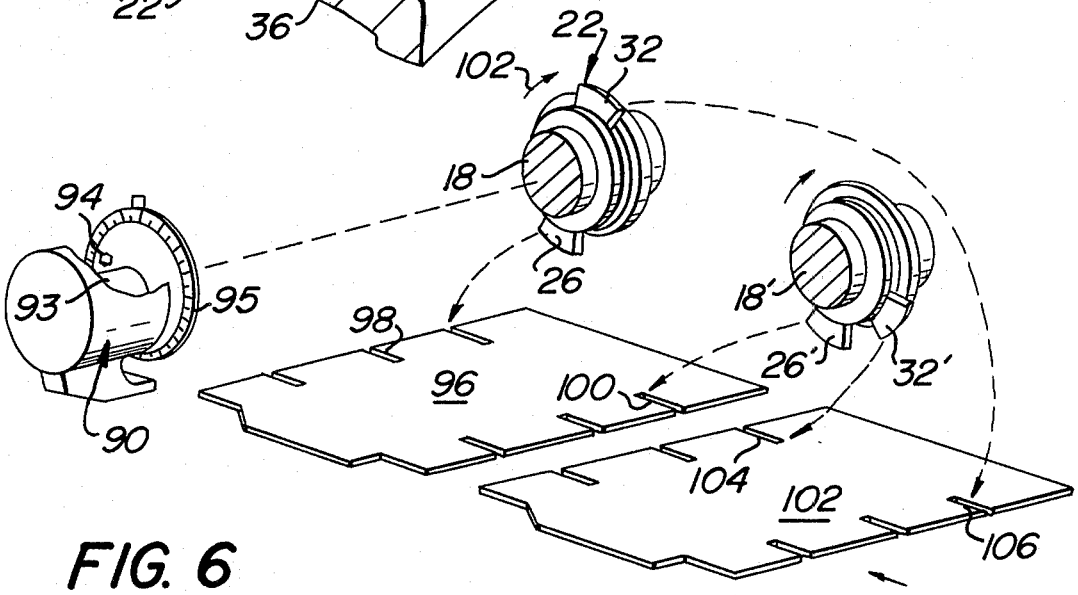
FIG. 6 is a diagrammatic perspective view with respect to features of the present invention.

The operation of the apparatus 10 is connection with slotting of paperboard is well known to those skilled in the art except for those features of the present invention which will now be explained. Let it be assumed that a production run of box blanks has just been completed. The next production run, for purposes of explanation, will be with a box blank 96 wherein the distance between the adjacent ends of the slots 98 and 100 is greater than that of the completed run. Hence, knife 32 must be rotated in a direction of arrow 102 in FIG. 6 for a predetermined distance thereby increasing the circumferential distance between the tops 28 and 34 on the knives 26 and 32 respectively.

A clutch may be provided between shaft 18 and its main drive. If such a clutch is provided, it will be deactivated. Thereafter, compensator 90 will be activated to rotate shaft 18 so that knife 32 is in the position shown in FIG. 2. Cylinder 84 is activated so as to cause plunger 86 to project downwardly into the notch 60. Thereafter, compensator 90 is utilized to rotate shaft 18 in a clockwise direction in FIG. 2 until roller 70 contacts plunger 86. Such clockwise rotation of shaft 18 and head 22 results in the plunger 86 contacting the roller 70 and unlocking the knife carrier 44 with respect to the head 22.

In the unlocking of the knife carrier 44 with respect to the head 22, spring 76 is compressed due to contact between plunger 86 and roller 70 whereby roller 70 can now rotate about its axis. Immediately thereafter, plunger 86 contacts the front face of the body portion 54 so that the knife carrier 44 is held stationary while the remainder of head 22 rotates about the axis of shaft 18 in a clockwise direction in FIG. 2. Each of the rollers 70 and 72 remains in rolling contact with the rotating wear plate 74. Shaft 18 is rotated so that tip 34 on knife 32 will be properly orientated with respect to tip 28 on knife 26 which remains in a fixed position on head 22. The graduations on the register dial 95 correspond to the desired distances between cutting tip 28 and cutting tip 34. By observing the extent of rotation of the register arrow 94 with respect to the register dial 95, the operator may attain the proper amount of rotation between knife 32 and knife 26. The rotation of shaft 18 by the compensator 90 is sufficiently slow that the adjustment of the knife 32 may be properly attained.

As soon as the knife 32 is in its proper position for the next production run, the compensator motor 93 is stopped and the plunger 86 is retracted. Spring 76 expands and wedges the rollers 70 and 72 between their respective wear plates. As a result thereof, the knife carrier 44 has been relocked with respect to the head 22. Immediately thereafter, the next production run may commence. With the blades on each slotter shaft 18, 18′ identically located, the blades on shaft 18′ cut slot 98, 108 and the blades on shaft 18 pass through the previously cut slots 98, 100 effectively doing no work.

In connection with the adjustment of the knife 32, it will be noted that it was not necessary to open up the sections of the printer slotter nor was it necessary for an operator to crawl in between the shafts and adjust a knife by loosening and tightening bolts. Further, adjustment of knife 32 in accordance with the present invention is more rapid and accurate due to the accessibility of the dial 95 which can be readily observed by the operator. Further, the adjustable knives 32 on the heads 22 may be simultaneously or independently adjusted in accordance with the present invention depending on the number of plungers 86 which were moved to an operative position.

In connection with the above description, it was assumed that adjustment of the knife 32 was to be in a direction so as to increase the distance between the adjacent ends of slots 98 and 100. In effecting such adjustment, the plunger 86 was caused to enter notch 60. If the adjustment is to be in the opposite direction, head 22 will be oriented so that the plunger 86 enters the notch 62 and engages the roller 72. The rollers 70, 72 when biased apart by spring 76 as described above constitute a means for self-locking the knife carrier 44 to the head 22.

When it is desired to process two blanks, such as blanks 96 and 102, per revolution of the shafts 18, 18′, the blades on shafts 18, 18′ are adjusted to different positions. See FIG. 6 wherein blade 26 cuts slot 98 on blank 96, blade 32 cuts slot 106 on blank 102, blade 26′ cuts slot 100 on blank 96, and blade 32′ cuts slot 104 on blank 102. The total length of blanks 96, 102 must be less than the maximum sheet size the apparatus can handle per single revolution of the shafts 18, 18′. For example, a 50 inch machine can process blanks, up to 50 inches in length per revolution of the shafts 18, 18′. When processing two blanks per revolution of the shafts 18, 18′, each such blank must be less than 25 inches in length.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for processing planar box blanks comprising a pair of shafts mounted for rotation about their longitudinal axes, an annular head connected to each shaft for rotation therewith, at least one slotter knife releasably mounted on said head and projecting beyond the periphery of said head, means for releasably locking each knife to its head, motor means for rotating said shafts through a preselected angle, and means for releasing said locking means and retaining said slotter knife stationary so that said shafts may be rotated by the motor means through the preselected angle whereby the position of the slotter knives on the heads may be adjusted to the same or different positions on said shafts depending on whether one or two blanks is to be processed per revolution of the shafts.

2. Apparatus in accordance with claim 1 wherein said locking means includes a knife carrier mounted on said heads for circumferential movement about the axis of the heads, and a self-locking means extending between each head and its knife carrier.

3. Apparatus in accordance with claim 2 wherein said self-locking means includes a roller having its longitudinal axis parallel to the axis of its head, a wear plate on said knife carrier, and spring means biasing said roller against said plate wedge said knife carrier against its head in a predetermined position.

4. Apparatus in accordance with claim 1 wherein said means for releasing said locking means includes a motor operated plunger, a yoke supporting said plunger, said yoke being coupled to said head for moving with said head in an axial direction along its shaft.

5. Apparatus in accordance with claim 4 wherein said locking means includes a knife carrier, said knife carrier having a notch on at least one end thereof, said notch being of sufficient size as to accommodate said plunger, said plunger being mounted for movement in a radial direction with respect to said head, and said knife carrier being supported on said head adjacent the outer periphery of said head for movement in a circumferential direction on said head.

6. Apparatus for slotting and scoring planar box blanks comprising a frame, a slotting head assembly on said frame, said assembly including a pair of slotter shafts mounted for rotation about their longitudinal axes, an annular head connected to each shaft for rotation therewith and for reciprocation therealong, a knife carrier supported by each head adjacent the outer periphery thereof for circumferential movement about the axis of its head, a slotter knife connected to each knife carrier, means for releasably locking each knife carrier to its head, and means for selectively releasing said locking means including an element mounted for movement from an inoperative position radially outward from said heads to an operative position wherein the element extends radially inward to a position for contact with one of said knife carriers, and a pair of scorer shafts disposed one above the other and located between vertical planes containing the axes of said slotter shafts.

7. Apparatus for slotting blanks comprising means for slotting the leading and trailing edges of a single blank per revolution of a slotting means and for slotting the leading and trailing edges of two smaller blanks per revolution of the slotting means wherein the combined length of the two smaller blanks is less than the length of the single blank, said means including parallel slotting shafts having circumferentially adjustable knives adjustably positionable so as to locate the knives on said shafts in one position when processing a single blank per revolution of the shafts and to locate the knives in different positions when processing two blanks per revolution of said shafts.

* * * * *